US007480966B2

(12) United States Patent
Celli

(10) Patent No.: US 7,480,966 B2
(45) Date of Patent: Jan. 27, 2009

(54) MIXING DEVICE FOR A HEAD FOR DRY-FORMING PAPER AND ASSOCIATED METHOD

(75) Inventor: Alessandro Celli, Lucca (IT)

(73) Assignee: A. Celli Nonwovens S.p.A., Lucca (IT)

( * ) Notice: Subject to any disclaimer, the term of this patent is extended or adjusted under 35 U.S.C. 154(b) by 146 days.

(21) Appl. No.: 10/562,764

(22) PCT Filed: Jul. 2, 2003

(86) PCT No.: PCT/IT03/00414

§ 371 (c)(1),
(2), (4) Date: Dec. 28, 2005

(87) PCT Pub. No.: WO2005/003421

PCT Pub. Date: Jan. 13, 2005

(65) Prior Publication Data

US 2006/0174452 A1 Aug. 10, 2006

(51) Int. Cl.
*D01G 25/00* (2006.01)

(52) U.S. Cl. ..... 19/304

(58) Field of Classification Search ..... 19/18, 19/304, 16, 26, 44, 94, 45
See application file for complete search history.

(56) References Cited

U.S. PATENT DOCUMENTS

| | | | | |
|---|---|---|---|---|
| 672,297 | A * | 4/1901 | Swenson et al. | 19/45 |
| 1,020,108 | A * | 3/1912 | McCormick | 19/45 |
| 2,676,694 | A * | 4/1954 | Wyss et al. | 198/534 |
| 3,581,706 | A | 6/1971 | Rasmussen | |
| 4,014,635 | A | 3/1977 | Kroyer | |
| 4,106,163 | A | 8/1978 | Desverchére | |
| 4,144,619 | A | 3/1979 | White et al. | |
| 4,157,724 | A * | 6/1979 | Persson | 141/1 |
| 4,276,248 | A | 6/1981 | Widnall | |
| 4,285,647 | A | 8/1981 | Dunkerly, II | |
| 4,335,066 | A | 6/1982 | Dinius | |
| 4,351,793 | A | 9/1982 | Day | |
| 4,352,649 | A | 10/1982 | Jacobsen et al. | |
| 4,482,308 | A | 11/1984 | Johnson | |
| 4,494,278 | A | 1/1985 | Krøyer et al. | |
| 4,627,953 | A | 12/1986 | Johnson | |
| 4,650,409 | A * | 3/1987 | Nistri et al. | 425/82.1 |
| 5,471,712 | A | 12/1995 | Kroyer | |
| 5,527,171 | A | 6/1996 | Soerensen | |
| 6,233,787 | B1 | 5/2001 | Eriksen et al. | |

FOREIGN PATENT DOCUMENTS

| | | |
|---|---|---|
| EP | 0 159 618 | 10/1985 |
| GB | 1 499 687 | 2/1978 |
| GB | 2 010 934 | 7/1979 |

(Continued)

*Primary Examiner*—Tejash Patel
(74) *Attorney, Agent, or Firm*—McGlew & Tuttle, P.C.

(57) ABSTRACT

A mixing device (9) for fibers in a gaseous flow, specifically designed to be arranged on the line supplying a head for forming air-laid webs, is described. The device comprises a duct (11) for fibers suspended in a gaseous flow, with an inlet (13) and an outlet (15). A plurality of rotors (16-19), perpendicular to said flow and equipped with radial elements (43), is provided between the inlet and the outlet.

15 Claims, 4 Drawing Sheets

FOREIGN PATENT DOCUMENTS

| | | |
|---|---|---|
| GB | 1 559 274 | 1/1980 |
| WO | WO 91/05100 | 4/1991 |
| WO | WO 95/22656 | 8/1995 |
| WO | WO 99/54537 | 10/1999 |
| WO | PCT/IT02/00657 | 10/2002 |
| WO | PCT/IT03/00020 | 1/2003 |

* cited by examiner 17
16
F
43
43
41
41

MIXING DEVICE FOR A HEAD FOR DRY-FORMING PAPER AND ASSOCIATED METHOD

TECHNICAL FIELD

The present invention relates to a mixing device for mixing the fibers in a gaseous flow, typically an air flow, which supplies a head for dry-forming paper, using the so-called air-laid process.

STATE OF THE ART

Methods and machinery in which a watery slurry of cellulose fibers is distributed on a forming wire in order to form a thin web are usually used for the production of webs or sheets of fibrous material, in particular paper, absorbent paper or so-called tissue paper. This web is then dried by means of suction of the water and subsequent passing over a heated roller or other drying device.

Relatively recently a new method has been introduced for the production of paper, in particular high-thickness absorbent paper for example for the production of sanitary articles, such as diapers for babies or female sanitary napkins. This method envisages the distribution, over a forming wire or mesh, of a web of fibers supplied by means of an air flow. The method is referred to by the term "air-laid".

In order to implement this dry formation method, devices of various types have been designed in order to obtain as uniform as possible distribution of the fibers and overcome many drawbacks and problems posed by this new technique.

In general, the production of air-laid webs envisages suspending the fibers in an air flow and depositing them on a forming mesh or wire, underneath which a suction is generated in order to convey the fibers supplied from a forming head situated above. The fibers are distributed in the air flow using various techniques.

A first category of devices envisages the use of a forming head with a bottom meshed screen through which the fibers are drawn by an air current pass. A forming mesh, on which the fibers are deposited in order to form the web, moves underneath the meshed screen which closes the forming head underneath. Propellers rotating about a vertical axis, i.e. perpendicular to the forming mesh and the screen, are arranged above the bottom closing screen of the forming head. The fibers are drawn by an air current through the head closing screen and are deposited on the forming mesh. Examples of devices designed in this way are described in GB-1499687, GB-1559274, U.S. Pat. Nos. 3,581,706, 4,014,635, 4,157,724, 4,276,248, 4,285,647, 4,335,066, 4,351,793, 4,482,308, 4,494,278, 4,627,953, 5,527,171, 5,471,712, WO-A-9105100, WO-A-9522656, WO-A-9610663, WO-A-9954537 and EP-B-616056.

A second type of device for distributing the fibers in the air flow which is sucked through the forming wire envisages the use of one or more perforated ducts with an axis parallel to the forming mesh. The fibers drawn by the air emerge from the holes in the ducts and are deposited on the underlying forming mesh which advances in the feeding direction. EP-A-032772 describes a forming head of this type. A pair of parallel-axis tubes are arranged above the forming mesh. The tubes have perforated walls through which the fibers conveyed by an air flow inside the said tubes emerge. In order to favor the outflow of the fibers and prevent blockage of the holes, rotating shafts with an axis parallel to the axis of the tubes and equipped with radial arms are arranged inside the tubes. The arms have the function of breaking up any lumps of fibers which are formed in the conveying air flow. Devices based substantially on the same principle are described in U.S. Pat. No. 4,352,649, WO-A-8701403 and EP-B-188454. In these devices the forming head is without the bottom closing screen and the flow of air and suspended fibers is confined inside the perforated-wall ducts, the perforated wall having the function of the head closing screen of the first type mentioned above.

U.S. Pat. No. 6,233,787 describes a device for dry-forming a fiber web in which a head which receives an air flow with the suspended fibers is arranged above the forming wire. The head has at the bottom a series of rotating shafts or rollers with axes parallel to each other and to the forming mesh, extending transversely with respect to the direction of feeding of the forming mesh. The shafts or rollers have radial arms or stems extending such as to close substantially the bottom opening of the head, forming a kind of pervious wall which allows the passage of the fibers drawn by the air flow sucked from underneath the forming wire.

EP-A-159618 describes a device for dry-forming a web of fibers, comprising a forming head situated above the forming wire through which the air current which conveys the fibers is sucked. The forming head is closed at the bottom by a fixed screen which is perforated so as to allow the fibers to pass through. Above the fixed screen there is a plurality of rollers with axes parallel to the forming wire and perpendicular to the direction of feeding of the latter. The rollers are equipped with radial arms and are supported by a continuous conveyor which causes displacement thereof parallel to the direction of feeding of the forming wire.

The co-pending international patent application No. PCT/IT02/00657 in the name of the same applicant describes a different and improved type of head for forming air-laid webs, which overcomes some of the drawbacks and limitations of the known devices.

In the co-pending international patent application in the name of the same applicant PCT/IT03/00020.

One of the critical aspects of these plants is mixing of the fibers in the stream of gaseous flow which supplies the forming head. The fibers must be uniformly distributed and not form lumps.

OBJECTS AND SUMMARY OF THE INVENTION

The object of the present invention is to provide a device and a method which allows more efficient supplying of a head for dry-forming paper using the so-called air-laid technique.

This and further objects and advantages, which will become clear to those skilled in the art from reading of the text which follows, are essentially obtained by means of a mixing device, comprising a duct for fibers suspended in a gaseous flow with an inlet and outlet and, between the inlet and outlet, a plurality of rotors, preferably with parallel axes, perpendicular to the flow and equipped with radial elements, for example elements in the form of needles or rods.

It is possible to envisage two or more pairs of rotors, where the rotors of each pair are parallel with each other. Preferably, all the rotors of the various pairs have axes parallel to each other.

According to a particularly advantageous embodiment of the invention, when two pairs of rotors are envisaged, the rotors of the first pair rotate in opposite directions to each other and the rotors of the second pair rotate in opposite directions to each other. The directions of rotation are chosen so that one pair of rotors tends to produce a denser arrangement of the fibers in the central zone of the duct, while the other pair tends to produce a denser arrangement of the fibers toward the walls of the duct in which the rotors are arranged.

According to a different aspect, the invention relates to a device for dry-forming a fibrous web material, comprising a pervious forming wire, a forming head on a first side of said wire and a suction box on the opposite side of said wire, said forming head being supplied, by means of a supply duct, with fibers suspended in a gaseous flow. Characteristically a mixing device of the type indicated above is arranged on the duct supplying the flow of fibers and air.

According to a further aspect of the invention, a method for forming a fibrous web product is envisaged, said method comprising the steps of:

supplying fibers suspended in a gaseous flow to a forming head by means of a supply duct;

depositing a layer of fibers by means of said forming head onto a movable forming wire, wherein characteristically it is envisaged mixing the fibers in a gaseous suspension inside said supply duct.

Further advantageous features and embodiments of the invention are indicated in the accompanying claims and will be described below with reference to an example of embodiment.

BRIEF DESCRIPTION OF THE DRAWINGS

The invention will be better understood with reference to the description and the attached drawing which shows a practical non-limiting embodiment of the invention. In the drawing.

DETAILED DESCRIPTION OF THE PREFERRED EMBODIMENT OF THE INVENTION

Figure 1:
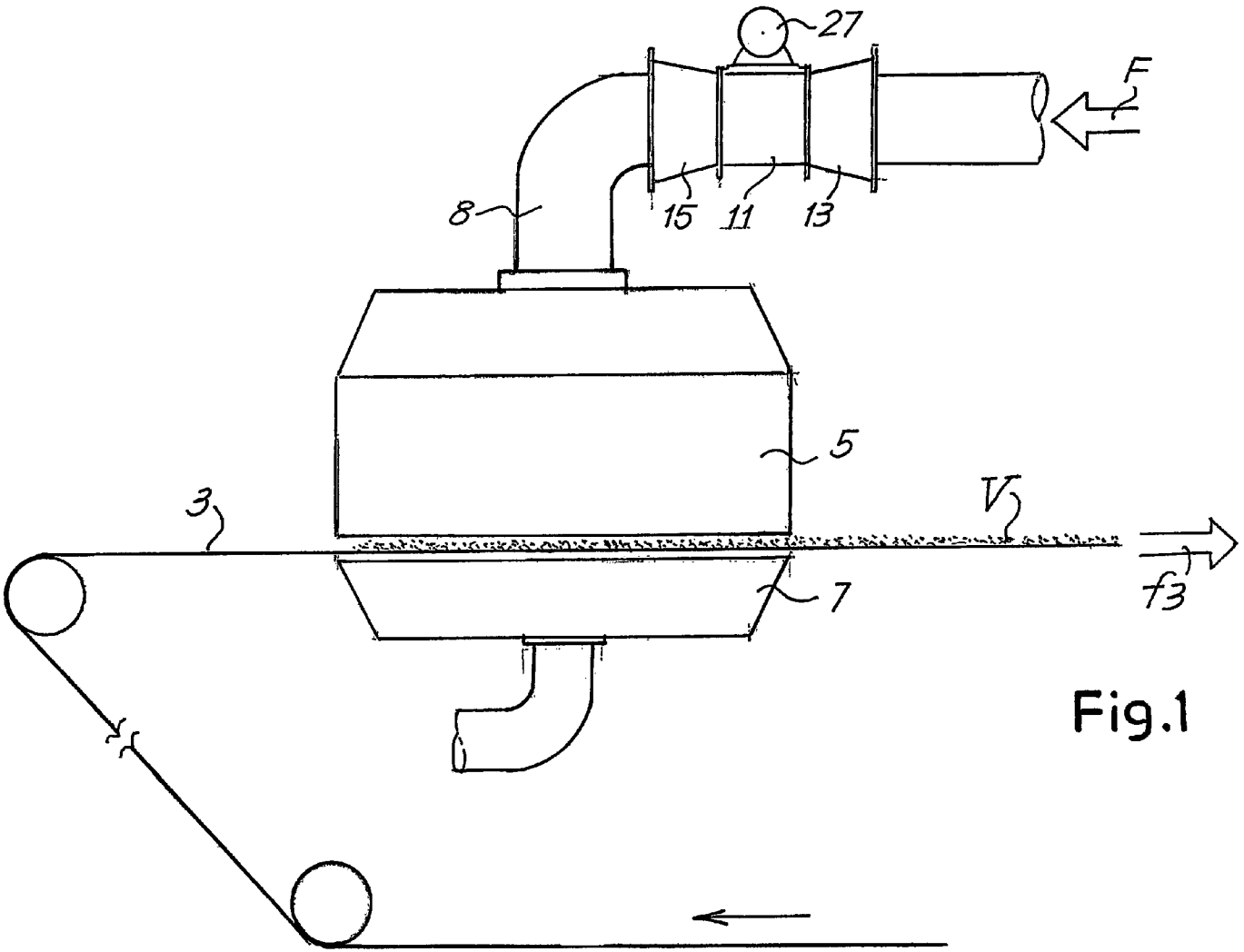
FIG. 1 shows in very schematic form a device for dry-forming a web of paper or similar product using the air-laid technique.

FIG. 1 shows, in very schematic form, a device for dry-forming a web V of paper or similar product, of the air-laid type. The web V is formed on a forming wire or mesh 3 which advances in the direction of the arrow f3 between a forming head 5 and a suction box 7, the head 5 and the box 7 being arranged on two opposite sides of the forming wire 3.

A gaseous flow, in particular air, with the cellulose fibers and any other products intended to form the web V suspended therein is supplied to the forming head 5 by means of a duct 8. The configuration of the head 5 and the suction box 7 may be of any kind. These plant parts may be designed in accordance with that which is described in one or more of the publications mentioned in the introductory part of the present description.

Figure 2:
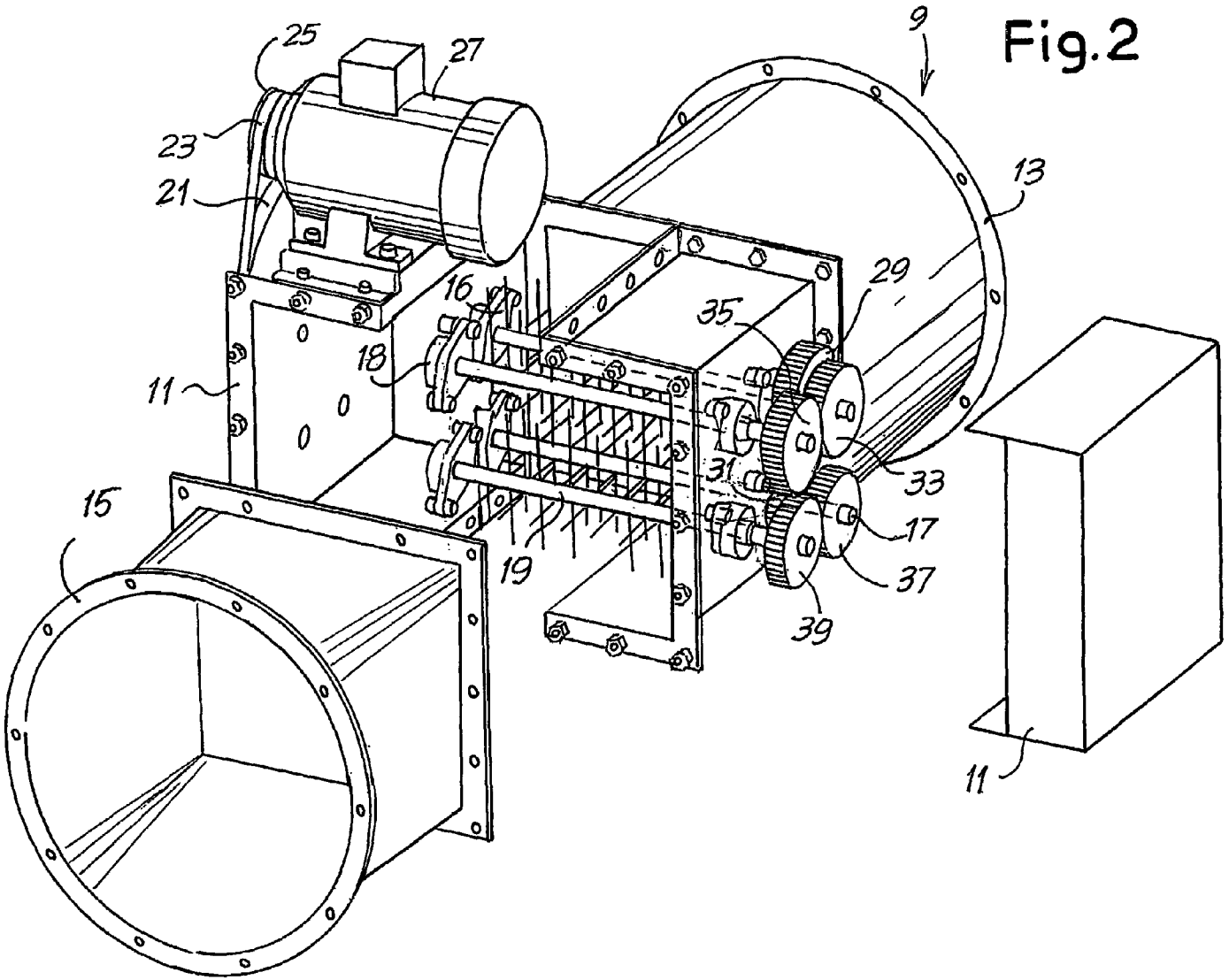
FIG. 2 shows an exploded perspective view, with parts removed, of the mixing device according to the invention.

A mixing device denoted in its entirety by 9 and illustrated in greater detail in the following figures is situated along the duct 8 supplying the gaseous flow and suspended fibers. With particular reference to FIG. 2, the mixing device 9 comprises a duct 11—with a rectangular cross-section in the example shown—connected by means of an inlet 13 and an outlet 15 to the gas and fiber flow supply line.

Four rotors, denoted by 16, 17, 18 and 19, are arranged, in the example shown, within the cross-section of the duct 11, between the inlet 13 and the outlet 15. More particularly, a first pair of rotors 16, 17 with axes of rotation perpendicular to the direction of the flow of air and fibers is arranged toward the inlet 13, while a second pair of rotors 18 and 19, also with the axes of rotation parallel to each other and parallel to the axes of rotation of the rotors 16 and 17, is arranged toward the outlet 15.

As can be seen in the exploded view shown in FIG. 2, the rotor 16 receives the movement from a pulley 21 rotationally driven by means of a belt 23 wound around a pulley 25 made to rotate by a motor 27. At the opposite end to that on which the pulley 21 is keyed, the rotor 16 is equipped with a gear wheel 29 which meshes with a gear wheel 31 keyed onto the axis of the underlying rotor 17. A second gear wheel 33 is also keyed onto the axis of the rotor 16, said gear wheel meshing with a gear wheel 35 keyed onto the axis of the rotor 18. On the other hand, a gear wheel 37 which meshes with a gear wheel 39, keyed onto the axis of the rotor 19, is keyed onto the axis of the rotor 17.

With this arrangement, the rotors 16, 17 of the first pair rotate in opposite directions and the rotors 18, 19 of the second pair rotate in opposite directions. The directions of rotation of the four rotors may be those indicated by f16, f17, f18 and f19 in FIG. 4 or in FIG. 5. F denotes the direction of supply of the air flow and suspended fibers.

Figure 4:
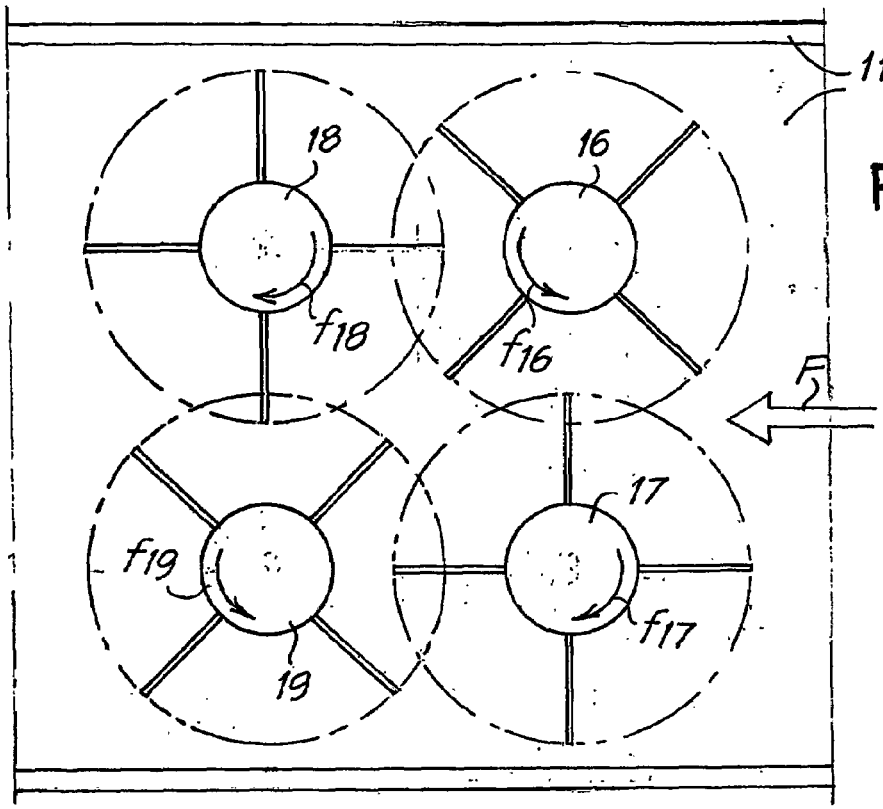
FIGS. 4 and 5 show schematically a side view of two modes of operation of the rotors of the mixing device.

When the rotors rotate in the directions shown in FIG. 4, the rotors 16, 17 of the first pair tend to produce a denser arrangement of the fibers suspended in the gaseous flow stream F toward the top and bottom walls of the duct 11, while the rotors 18, 19 of the second pair tend to produce a denser arrangement of the fibers in the central zone of the said duct.

Figure 5:
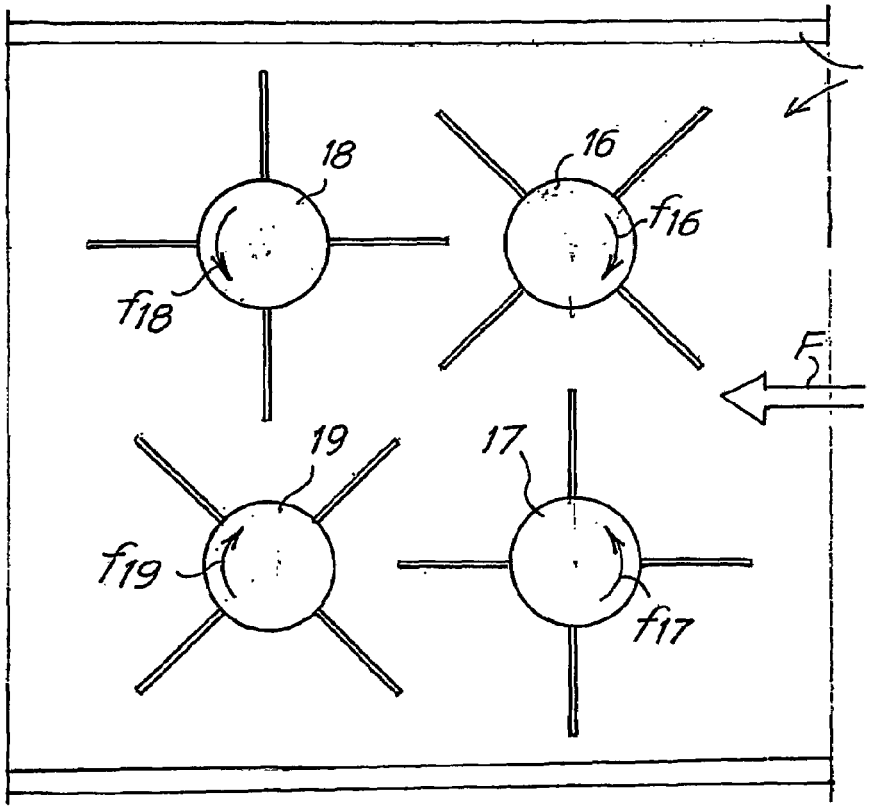

The opposite effect is obtained with the directions of rotation shown in FIG. 5. Here the fibers suspended in the gaseous flow F tend to be densely arranged in the central zone of the duct 11 by the rotors 16, 17 of the first pair, while they tend to be arranged densely against the top and bottom walls of the duct 11 by the rotors 18, 19 of the second pair.

Whatever the configuration chosen, be it that of FIG. 4 or that of FIG. 5, rotation of the rotors causes intense mixing of the fibers in the gaseous flow owing to the vertical effects which are produced inside the duct 11.

The directions of rotation of the rotors may be reversed during operation and the speed of rotation may be varied so as to be greater or less than the speed of conveying of the fibers in the gaseous current, depending on the specific processing requirements.

The mixing effect is increased owing to the fact that the duct 11 has a smaller throughflow cross-section than the cross-section of the inlet 13 and the outlet 15, with a consequent acceleration in the gaseous flow in the zone where the rotors are arranged.

Figure 3:
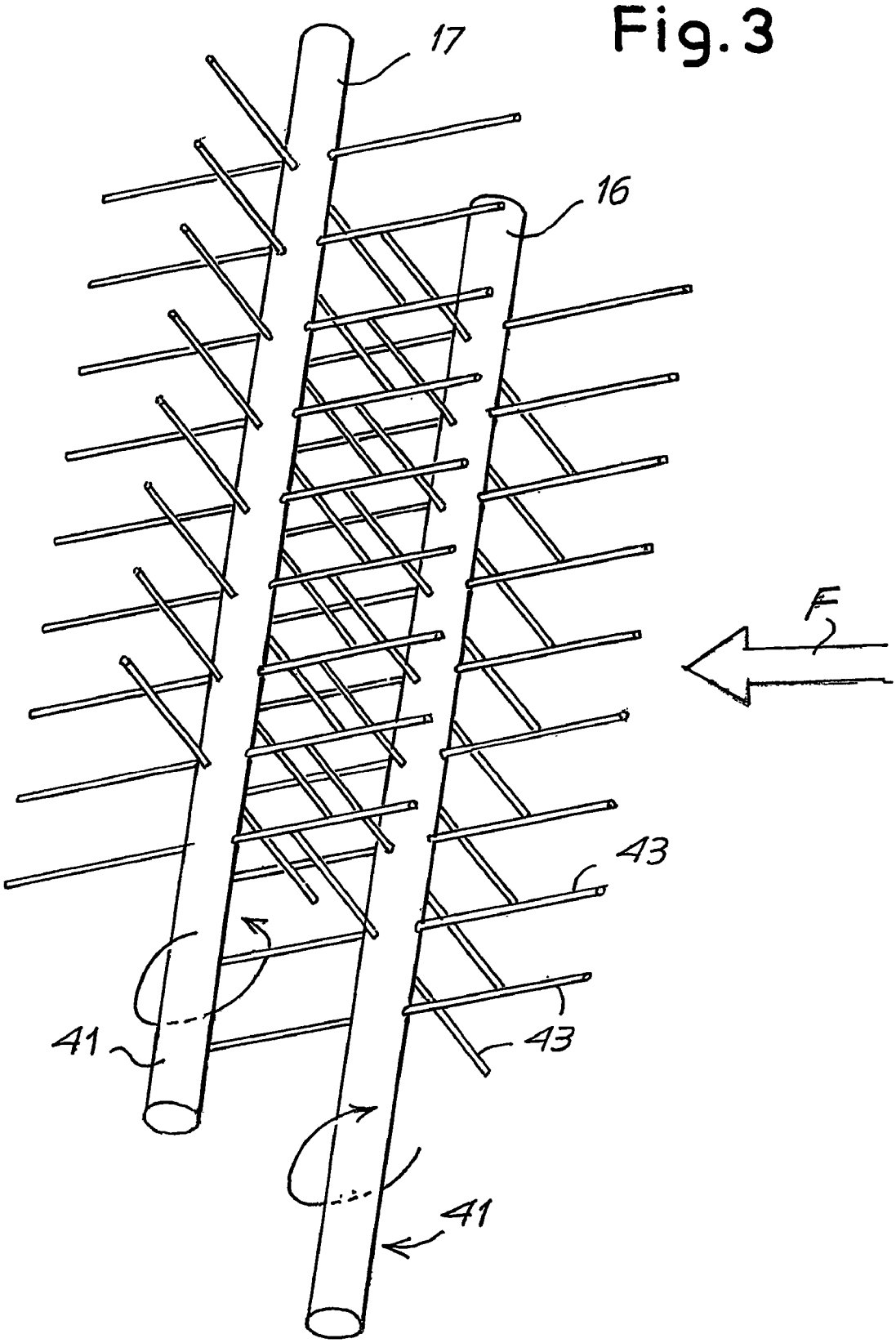
FIG. 3 shows a perspective view of a pair of rollers.

The rotors 16, 17, 18 and 19 have, in the example illustrated, the configuration shown in detail in FIG. 3, with reference to the rotors 16 and 17. Each rotor comprises a shaft 41 having a diameter which is relatively small compared to the overall cross-section of the said rotor. Rod-shaped radial elements 43 are mounted on the shaft 41. The elements 43 are arranged in two directions staggered at 90° and the rod-shaped elements of a rotor are axially staggered with respect to those of the adjacent rotors. In this way, collision between the rod-shaped elements 43 of adjacent rotors is avoided, although these elements have a radial extension such that the envelope of the rod-shaped elements of the various rotors is formed by cylindrical virtual geometric surfaces intersecting each other, as can be seen in particular in FIG. 4, where the envelopes are shown in dot-dash lines.

It is understood that the drawing shows only one example provided by way of a practical demonstration of the invention, the forms and arrangements of said invention being able to be varied without thereby departing from the scope of the idea underlying the said invention.

The invention claimed is:

1. A device for mixing fibers in a gaseous flow, the device comprising:

a pervious forming wire;

a forming head facing a first side of said forming wire;

a suction box facing a second side of said forming wire;

a fiber feeding duct for feeding fibers suspended in a gaseous flow into said forming head, said duct having an end in communication with an interior of said forming head;

a fiber mixing device arranged in an intermediate position along said fiber feeding duct, said fiber mixing device being upstream of said forming head, said fiber mixing device including an inlet side and an outlet side, said fiber mixing device including at least a first pair of rotors on the inlet side and a second pair of rotors on the outlet side, said rotors having radially projecting elements, said rotors being arranged such that each rotation axis of each rotor is substantially orthogonal to said gaseous flow.

2. Device according to claim 1, wherein the rotors of each pair have axes of rotation parallel to each other.

3. Device according to claim 1, wherein the rotors of the various pairs have axes of rotation parallel to each other.

4. Device according to claim 2, wherein the rotors of the various pairs have axes of rotation parallel to each other.

5. Device according to claim 1, wherein the rotors of the first pair rotate in opposite directions to each other and the rotors of the second pair rotate in opposite directions to each other.

6. Device according to claim 5, wherein the rotors of the first pair rotate such that a denser arrangement of the fibers is produced in the passing flow toward the central zone of the duct, said rotors of the second pair rotating such that a denser arrangement of the fibers is produced in the passing flow toward the peripheral zone of the duct.

7. Device according to claim 5, wherein the rotors of the first pair rotate such that a denser arrangement of the fibers is produced in the passing flow toward the peripheral zone of the duct, said rotors of the second pair rotating such that a denser arrangement of the fibers is produced in the passing flow toward the central zone of the duct.

8. Device according to claim 1, wherein the radial elements of said rotors comprise rod-shaped members connected to a respective rotating shaft.

9. Device according to claim 1, wherein said duct has at least one portion with a rectangular or square cross-section, in which said rotors are inserted.

10. Device according to claim 1, wherein said radial elements have an extension such that the envelopes of adjacent rotors interfere with each other.

11. Device according to claim 1, wherein said rotors are actuated at a variable speed.

12. A method for forming a strip-shaped fibrous article, comprising the steps of:

supplying fibers suspended in a gaseous flow to a forming head via a supply duct;

depositing a layer of fibers onto a movable forming wire via said forming head;

arranging in said supply duct at least a first pair of rotors and at least a second pair of rotors, said first pair of rotors being arranged adjacent said second pair of rotors in a direction of the gaseous flow within said supply duct;

counter-rotating the rotors of each pair about axes perpendicular to the gaseous flow within said duct;

mixing said fibers in a gaseous suspension inside said supply duct via said rotors before feeding said fibers to said forming head.

13. Method according to claim 12, further comprising the step of producing a denser arrangement of fibers in the central zone of the duct and subsequently a denser arrangement of the fibers in the peripheral zone of the supply duct.

14. Method according to claim 12, further comprising the step of producing a denser arrangement of fibers in the peripheral zone of the duct and subsequently a denser arrangement of fibers in the central zone of the supply duct by means of said two pairs of rotors.

15. A device for mixing fibers in a gaseous flow, the device comprising:

a duct for suspending fibers in a gaseous flow, with an inlet and an outlet and, between said inlet and said outlet, at least a first pair of rotors on the inlet side and a second pair of rotors on the outlet side, said rotors being arranged perpendicular to said flow and equipped with radial elements, wherein said duct has a transversal cross-section which is smaller than said inlet and said outlet.

* * * * *